US011049645B2

(12) United States Patent
Xu et al.

(10) Patent No.: US 11,049,645 B2
(45) Date of Patent: Jun. 29, 2021

(54) TRANSFORMER WITH AIR GUIDING PLATES

(71) Applicant: ABB Power Grids Switzerland AG, Baden (CH)

(72) Inventors: Ye Xu, Shanghai (CN); Yong Wang, Brilon (DE); Qiongfang Lu, Shanghai (CN); Wenhao Li, Zhongshan (CN)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/502,258

(22) Filed: Jul. 3, 2019

(65) Prior Publication Data

US 2019/0326050 A1 Oct. 24, 2019

Related U.S. Application Data

(63) Continuation of application No. PCT/CN2017/078154, filed on Mar. 24, 2017.

(51) Int. Cl.
*H01F 27/08* (2006.01)
*H01F 27/28* (2006.01)
(Continued)

(52) U.S. Cl.
CPC ..... *H01F 27/2876* (2013.01); *H01F 27/24* (2013.01); *H01F 27/2823* (2013.01); *H01F 2027/328* (2013.01)

(58) Field of Classification Search
CPC .. H01F 27/2876; H01F 27/24; H01F 27/2823; H01F 27/328; H01F 27/085;
(Continued)

(56) References Cited

U.S. PATENT DOCUMENTS 1,938,421 A * 12/1933 Gilbert ..... H01F 27/306 336/185
3,548,355 A * 12/1970 Miller ..... H01F 27/2847 336/60
(Continued)

FOREIGN PATENT DOCUMENTS

CN 201527878 U 7/2010
EP 0785560 A1 7/1997
(Continued)

OTHER PUBLICATIONS

Canadian Office Action dated Jul. 27, 2020 for Canadian Patent Application No. 3,048,931, 4 pages.
(Continued)

*Primary Examiner* — Mang Tin Bik Lian
(74) *Attorney, Agent, or Firm* — Sage Patent Group

(57) ABSTRACT

A transformer is disclosed. The transformer includes a first coil including a first stack of wire disks stacked in a first direction; an exterior barrier arranged to form a first air gap between outer sides of the wire disks of the first stack of wire disks and the exterior barrier; an interior barrier arranged to form a second air gap between inner sides of the wire disks of the first stack of wire disks and the interior barrier; a wind generator arranged to generate an air flow in the first direction; a core in the form of a cylinder that is surrounded by the first coil; and an air guiding plate fixed to one of the exterior barrier and the interior barrier, to guide the air flow in a second direction along first stack gaps between the wire disks of the first stack of wire disks. The transformer effectively improves the heat dissipation of the coil and thus allows a smaller transformer in size.

18 Claims, 4 Drawing Sheets

(51) Int. Cl.
*H01F 27/24* (2006.01)
*H01F 27/32* (2006.01)

(58) Field of Classification Search
CPC .. H01F 27/323; H01F 27/324; H01F 27/2871; H01F 2027/328
USPC ..... 336/5, 60, 179, 199, 206, 207
See application file for complete search history.

(56) References Cited

U.S. PATENT DOCUMENTS 3,902,146 A * 8/1975 Muralidharan ..... H01F 27/322 336/57
4,028,653 A * 6/1977 Carlsson ..... H01F 27/12 336/60
4,032,873 A 6/1977 Jallouk
8,049,587 B2 * 11/2011 Israelsson Tampe ... H01F 30/02 336/59
2001/0052835 A1 * 12/2001 Ito ..... H01F 27/322 336/57
2007/0279177 A1 * 12/2007 Sarver ..... H01F 27/2871 336/207
2014/0361862 A1 * 12/2014 Ballard ..... H01F 41/098 336/222

FOREIGN PATENT DOCUMENTS

JP 01010608 A * 1/1989
JP H05258972 A 10/1993
JP H07220940 A 8/1995
JP H09153415 A 6/1997
JP 2000260632 A 9/2000

OTHER PUBLICATIONS

State Intellectual Property of the P.R. China, International Search Report & Written Opinion issued in corresponding Application No. PCT/CN2017/078154, dated Dec. 27, 2017, 12 pp.

* cited by examiner

TRANSFORMER WITH AIR GUIDING PLATES

TECHNICAL FIELD

Example embodiments disclosed herein generally relate to a transformer, more specifically, to an open wound dry-type transformer with air guiding plates.

BACKGROUND

Like all of the electrical distribution equipment serving critical systems, transformers are key components widely used, with various types and specifications. For example, large dry-type distribution transformers are typically fed by medium-voltage power systems (tens of kilovolts) and feature a secondary voltage rating of 480V, 3-phase. Some of the larger common sizes of dry-type transformers available today have a capability up to tens of MVA (million VA). In these transformers, large current generates dramatic heat. Therefore, heat dissipation is vital when designing a distribution transformer.

An open wound dry-type transformer normally has a number of coils which are in the form of stacks of wire disks. Normally, the wire disks are stacked vertically. Currently, heat dissipation can be achieved by a fan disposed at the bottom of the stacks, but the fan is not able to effectively reduce the temperature deep inside the stacks.

SUMMARY

Example embodiments disclosed herein propose a structure of a transformer in which heat can be dissipated more effectively.

In one aspect, example embodiments disclosed herein provide a transformer. The transformer includes: a first coil including a first stack of wire disks stacked in a first direction; an exterior barrier arranged to form a first air gap between outer sides of the wire disks of the first stack of wire disks and the exterior barrier; an interior barrier arranged to form a second air gap between inner sides of the wire disks of the first stack of wire disks and the interior barrier; a wind generator arranged to generate an air flow in the first direction; a core in the form of a cylinder that is surrounded by the first coil; and an air guiding plate fixed to one of the exterior barrier and the interior barrier, to guide the air flow in a second direction along first stack gaps between the wire disks of the first stack of wire disks.

Through the following description, it would be appreciated that the transformer according to the present disclosure provides an effective structure by which the air flow can be directly thoroughly among the wire disks in the transformer, which in turn improve the efficiency of active dissipation. In this way, the dimension of the transformer can be reduced, because even a smaller gap between the wire disks can result in an improved performance of heat dissipation by the structure according to the present disclosure. In addition, material costs can be lowered because less material is required for passive heat sinks.

BRIEF DESCRIPTION OF THE DRAWINGS

Through the following detailed descriptions with reference to the accompanying drawings, the above and other objectives, features and advantages of the example embodiments disclosed herein will become more comprehensible.

In the drawings, several example embodiments disclosed herein will be illustrated in an example and in a non-limiting manner, wherein.

Throughout the drawings, the same or corresponding reference symbols refer to the same or corresponding parts.

DETAILED DESCRIPTION

Figure 1:
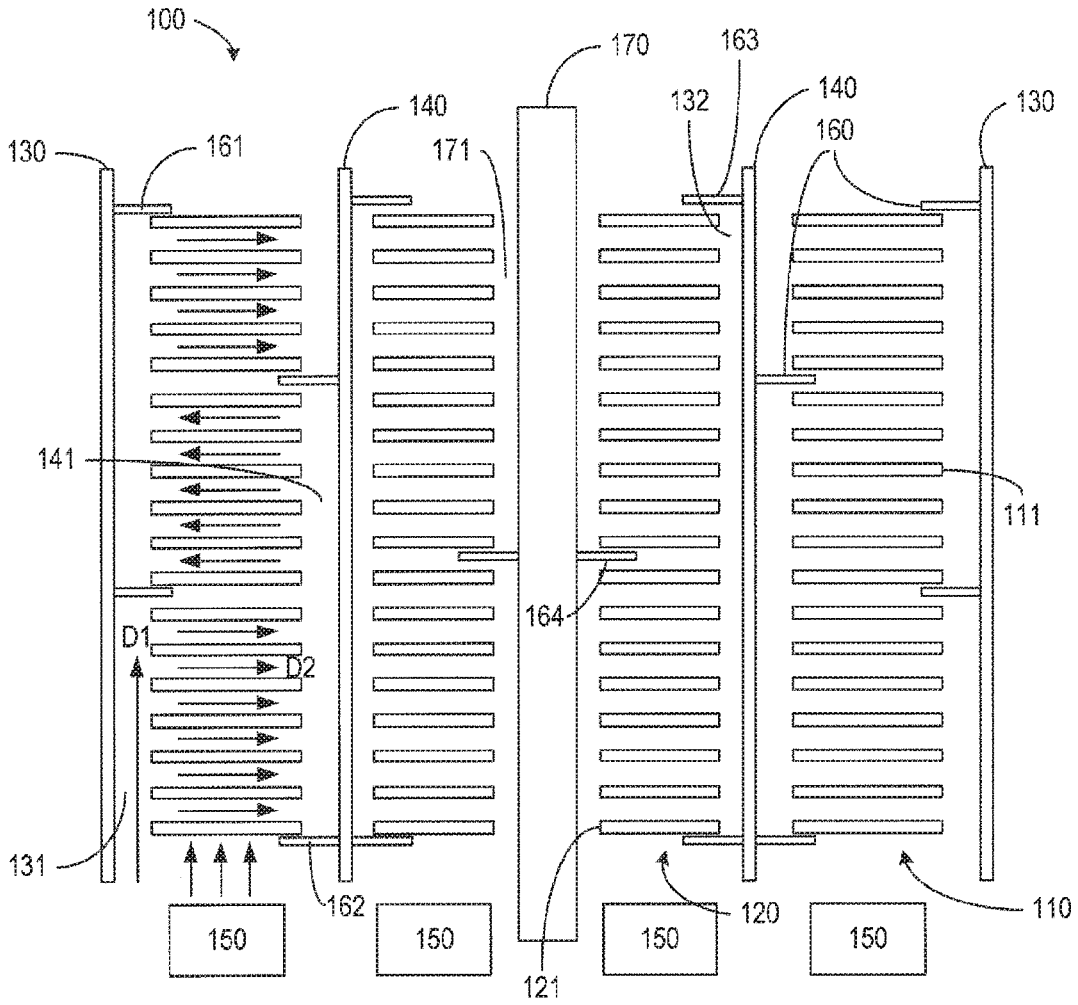
FIG. 1 illustrates a schematic section view of a transformer in accordance with one example embodiment.
Figure 2:
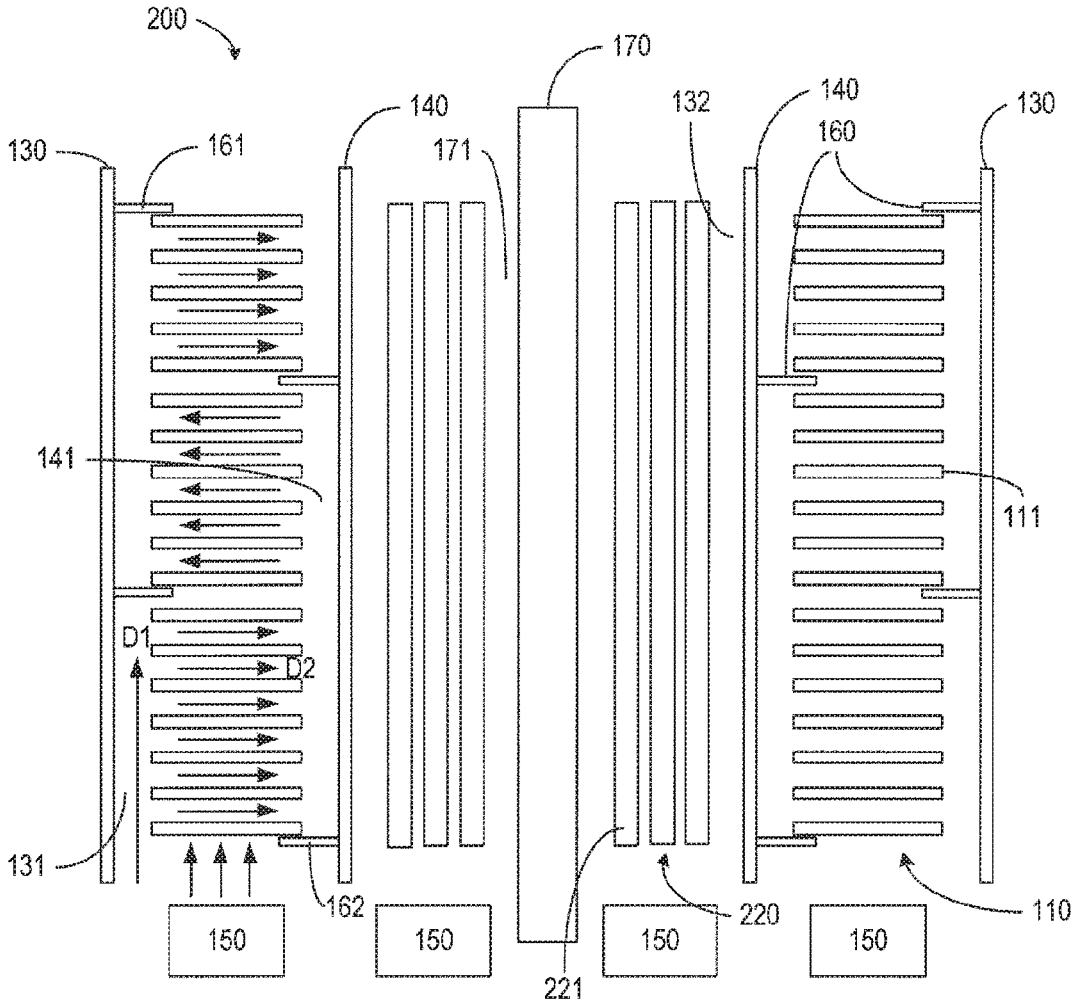
FIG. 2 illustrates a schematic section view of a transformer in accordance with another example embodiment.

The subject matter described herein will now be discussed with reference to several example embodiments. These embodiments are discussed only for the purpose of enabling those skilled persons in the art to better understand and thus implement the subject matter described herein, rather than suggesting any limitations on the scope of the subject matter.

The term "comprises" or "includes" and its variants are to be read as open terms that mean "includes, but is not limited to." The term "or" is to be read as "and/or" unless the context clearly indicates otherwise. The term "based on" is to be read as "based at least in part on." The term "being operable to" is to mean a function, an action, a motion or a state can be achieved by an operation induced by a user or an external mechanism. The term "one embodiment" and "an embodiment" are to be read as "at least one embodiment." The term "another embodiment" is to be read as "at least one other embodiment." Unless specified or limited otherwise, the terms "mounted," "connected," "supported," and "coupled" and variations thereof are used broadly and encompass direct and indirect mountings, connections, supports, and couplings. Furthermore, "connected" and "coupled" are not restricted to physical or mechanical connections or couplings. In the description below, like reference numerals and labels are used to describe the same, similar or corresponding pans in the several views of FIGS. 1-5. Other definitions, explicit and implicit, may be included below.

FIG. 1 illustrates a schematic section view of an example transformer 100. The transformer 100 includes a first coil 110 and a second coil 120. In one example, the first coil 110 is for high voltage while the second coil 120 is for low voltage. In some other examples, the first coil 110 is for low voltage while the second coil 120 is for high voltage. When the second coil 120 is arranged by stacking a number of wire disks, it can be structured in an analogous manner compared with the first coil 110, and thus features with respect to the first coil 110 will be explained in detail in the following.

As shown in FIG. 1, the first coil 110 includes a first stack of wire disks 111 which are stacked along a vertical direction in this example. However, it is to be understood that in some circumstances, the wire disks 111 can be stacked with a different angle in relation to ground on which the transformer 100 is placed. A first coil 110 may consist of one or more coil stacks. In this example, the first coil 110 includes one coil stack surrounding a common axis (typically, there is a core 170 in the transformer 100 extending along the same axis, as shown in FIG. 1). The one coil stack includes a number of wire disks 111 shaped as closed rings stacked bottom-up. There can be more than one coil stacks for the first coil 110, each wire disk being shaped as a sector of a closed ring. In other words, each piece of the wire disks 111 can be in a shape of a closed ring or of a sector as a part of the closed ring. Wire disks and coils are widely known in the field of transformers, and thus their features, functions and connections are not to be described in detail.

A core 170 can be an iron core commonly used for various transformers. The core 170 shown in FIG. 1 extends vertically in parallel with the direction D1. Although the core 170 is shown to be straight, it can be of other shapes such as a curve or a wave in some occasions.

An exterior barrier 130 is provided to form a first air gap 131 between outer sides of the wire disks 111 and the exterior barrier 130. The exterior barrier 130 is used for guiding the air flow along the first air gap 131 so as to bring away the generated heat from the wire disks 111. When the wire disks 111 are arranged in a way shown in FIG. 1, the first air gap 131 is extended in a vertical direction (D1 or in parallel with D1), and the outer sides of the wire disks 111 are the outer edges of the wire disks 111 with respect to the innermost core 170.

An interior barrier 140 is provided to form a second air gap 141 between inner sides (named with respect to the outer sides) of the wire disks 111 and the interior barrier 140. The interior barrier 140 is used for guiding the air flow along the second air gap 141 so as to bring away the generated heat from the wire disks 111. When the wire disks 111 are arranged in a way shown in FIG. 1, the second air gap 140 is extended in the vertical direction (D1 or in parallel with D1), and the inner sides of the wire disks 111 are the inner edges of the wire disks 111 opposite to the outer edges of the wire disks 111.

It is to be understood that, although FIG. 1 shows a cylindrical transformer 100 in which the exterior harrier 130, the interior barrier 140, the first coil 110 and the wire disks 111 surround a common axis (which is coincided with the core 170 in this example), they can be arranged in other ways. For example, the transformer can be a cuboid or a cube instead of a cylinder, and the wire disks can be in a shape of rectangular or polygon instead of sector. The exterior barrier, the interior barrier, the coil(s) and the core can be arranged not in a coaxial way. The present disclosure does not intend to limit the shapes, forms, materials and dimensions of these components.

As shown in FIG. 1, at the bottom of the transformer 100, one or more wind generators 150 can be provided to move (blow) air upward along the first and second air gaps 131, 141. However, it is to be understood that the wind generator 150 can be placed atop the transformer 100 (to suck in air) so long as the wind is substantially generated from bottom to top. In this example, the wind generator 150 can be a fan. Because hot air moves upward in atmosphere, the wind moving upward will be more effective in terms of heat dissipation compared with the situation in which the wind flows down. The air flow generated by the wind generator 150 is along the first direction D1 or in parallel with the first direction D1. In this example, the first direction D1 is a substantially vertical direction.

One or more air guiding plates are fixed to at least one of the exterior barrier 130 and the interior barrier 140. In one example, the air guiding plate is shaped to match the exterior barrier 130 or the interior barrier 140, so that the existence of the air guiding plate blocks most of the air flow along the first air gap 131 or the second air gap 141, respectively. As shown in FIG. 1, the air guiding plate may include two sets of plates, with the first set named to be one or more first air guiding plates 161 that are fixed to the exterior barrier 130, and the second set named to be one or more second air guiding plates 162 that are fixed to the interior barrier 140. Each of the first and second air guiding plates 161, 162 can protrude between adjacent wire disks 111 so that the air flow can be guided or directed in a second direction D2 substantially perpendicular to the first direction D1. It is to be understood that the first or second air guiding plate 161, 162 may not necessarily protrude into the wire disks 111 so long as most of the air flow can be redirected into the wire disks 111. The second direction D2 is along first stack gaps 114 between the wire disks 111. In this example, the second direction D2 can face toward the core 170 or face away from the core 170, and the first direction D1 can be angled with respect to the second direction D2 by an angle between 80 to 100 degrees.

The air flow generated by the wind generator 150 may travel in the following way. First of all, the generated air flow moves upward along the first air gap 131 until impinging on one of the first air guiding plate 161. Due to the blockage of the first air gap 131 by the first air guiding plate 161 fixed to the exterior barrier 130, the air flow will be redirected to move toward the interior barrier 140 via a number of first stack gaps 114 until impinging on die interior barrier 140. Then, the air flow is forced to move upward along the second air gap 141 until impinging on one of the second air guiding plate 162 fixed to the interior barrier 140. Due to the blockage of the second air gap 141 by the second air guiding plate 162, the air flow will be redirected to move toward the exterior barrier 130.

In this example, there are multiple first air guiding plates 161 provided on the exterior barrier 130, and multiple second air guiding plates 162 provided on the interior barrier 140. Each of the first and second air guiding plates 161, 162 are placed at different altitudes, so that the route of the air flow meanders throughout the first stock of wire disks 111.

In this way, the heat dissipation can be greatly improved, because the air flow passes almost each and every piece of the wire disks 111. In particular, the middle portions of the wire disks generate a lot of heat that are otherwise unreachable by the air flow if no air guiding plate is provided. In other words, if no air guiding plate is provided, even if the heat near the outer sides and the inner sides can be brought away by the air flow easily, the heat generated by the middle portions of the wire disks 111 can only be conducted to the outer and inner sides in a passive way, which is inefficient. Therefore, the existence of the air guiding plate forces the air flow in substantially horizontal directions, which cools down the overall temperature within the transformer 100 dramatically.

In some cases, even one air guiding plate is effective enough to lower the temperature in the middle portions of the wire disks 111. As such, the present disclosure does not intend to limit the quantity of the air guiding plate. In one example, the air guiding plate can protrude into the first stack of wire disks 111 to an extent that most of the air flow along either the first air gap 131 or the second air gap 141 is forced to change its travelling direction. As mentioned above, the air guiding plate may not protrude into the wire disks 111 as well, as long as a portion of the air flow is redirected into the first stack gap 114.

In one example, the first air guiding plate 161 (if existing) is fixed to the exterior barrier 130 in an air tight manner, and the second air guiding plate 162 (if existing) is fixed to the interior barrier 140 in an air tight manner. In this way, almost all the air flow will be redirected by die air guiding plate(s), forming a complete meander route passing through the wire disks. However, in another example, some holes or openings can be provided on the air guiding plate(s) as well. The area of the openings on the air guiding plate can be controlled so that the route of the air flow can be controlled accordingly.

Additionally or alternatively, the transformer 100 may include a second coil 120. In the example shown in FIG. 1, the second coil 120 includes a second stack of wire disks 121, and the second coil 120 is arranged between the core 170 and the interior barrier 140. A third air gap 132 is formed between the interior barrier 140 and outer sides of the wire disks of the second stack of wire disks 121, and a fourth air gap 171 is formed between the core 170 and inner sides of the wire disks of the second stack of wire disks 121. The outer sides of the second stack of the wire disks 121 approximate the interior barrier 140, and the inner sides of the second stack of the wire disks 121 approximate the core 170 and are opposite to the outer sides the second stack of the wire disks 121. The core 170 may or may not include a separate barrier.

In the example shown in FIG. 1, the wire disks of the second stack of wire disks 121 are arranged to be in parallel with the wire disks of the first stack of wire disks 111. The air flow generated by the wind generator 150 may be directed along the third air gap 132 and the fourth air gap 171. However, in some other examples (such as the one shown in FIG. 2, which is to be discussed in the following), one of the first and second coils 110, 120 can be arranged so that its wire disks are oriented vertically instead of horizontally.

A third air guiding plate 163 may be fixed to the interior burner 140 and a fourth air guiding plate 164 may be fixed to the core 170. Both of the third air guiding plate 163 and the fourth air guiding plate 164 may protrude between adjacent wire disks of the second stack of wire disks 121 to guide the air flow in the second direction D2 along second stack gaps 124 between the wire disks of the second stack of wire disks 121.

In another example, the second coil 120 may surround the core 170 and be arranged to be coaxial with the core 170, the exterior barrier 130 and the interior barrier 140. The third air guiding plate 163 may be in the form of a closed ring to be circumferentially fixed to the interior barrier 140, and the fourth air guiding plate 164 may be in the form of a closed ring to which the core 170 is circumferentially fixed. The third air guiding plate 163 may be fixed to the interior barrier 140 in an air tight manner, and the fourth air guiding plate 164 may be fixed to the core 170 in an air tight manner.

The arrangements of the components associated with the second coil 120 and the third and fourth air guiding plates 163, 164 may be in similar ways to those associated with the first coil 110 and corresponding air plate(s). The advantages brought by the third and fourth air guiding plates 163, 164 to the second stack of wire disks 121 are also related to the heat dissipation between the wire disks 121, and thus detailed descriptions will be omitted.

It should be understood that, although FIG. 1 illustrates that both the first coil 110 and the second coil 120 are arranged with each of the wire disks extending horizontally, one of the first and second coils 110, 120 can be arranged such that its wire disks extend vertically. The vertically arranged wire disks can be embodied in FIG. 2, in which the second coil 220 is provided which includes a number of wire disks 221 for a transformer 200. Given that the wire disks 221 extend vertically, the wire disks 221 can be arranged substantially coaxial with the core 170. Thus, the existence of the air guiding plate(s) is not necessary because the wind generator 150 placed at the bottom (or top) of the transformer 100 moves up the air flow through the stack gaps easily.

There can be more or less coil(s) in the transformer 100. For example, the interior barrier 140 can be regarded as the exterior surface of the core 170 in some cases where the second coil 120 or 220 does not exist, and thus the first coil 110 is located between the core 170 and the exterior barrier 130. In other scenarios, additional coil(s) may be stacked atop the existing coil(s) as well.

Figure 3:
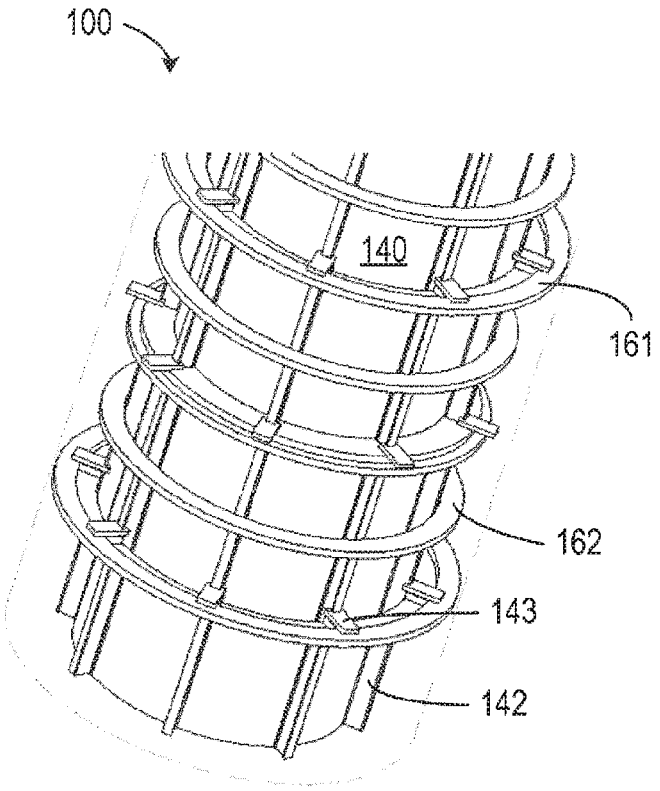
FIG. 3 illustrates a perspective view of the transformer in accordance with one example embodiment, with its outer barrier and coils removed for showing how the air guiding plates are arranged.

FIG. 3 illustrates a perspective view of the transformer 100, with its first (outer) barrier 130 and coils 110 removed for showing how the air guiding plates are arranged. As shown in FIG. 3, a number of ridges 142 are provided on the interior barrier 140, and they are spaced equally with each other in this example. The exterior barrier 130 is omitted in this figure, on which a number of ridges may be provided as well. The second air guiding plates 162 are directly fixed to the interior barrier 140. The ridges 142 may provide a separation for different sets of the first coils 110, as described above. Connecting members 143 may be provided on the ridges 142 for holding the first air guiding plates 161. In this way, the first and second air guiding plates 161, 162 are placed at different altitudes.

Figure 4:
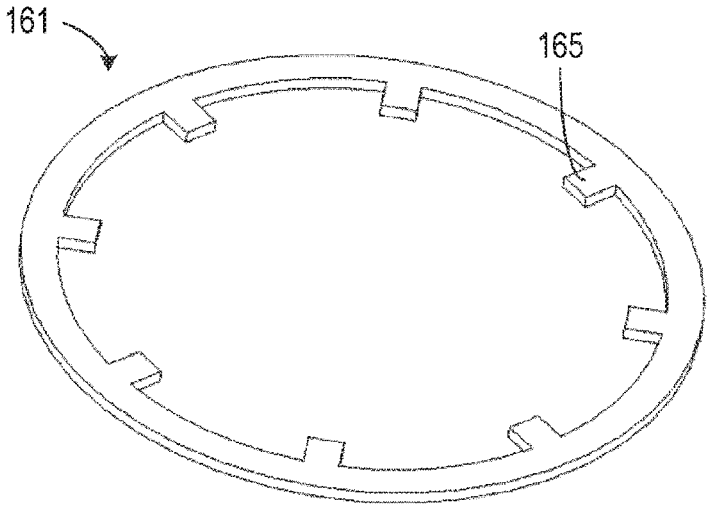
FIG. 4 illustrates an air guiding plate in accordance with one example embodiment.
Figure 5:
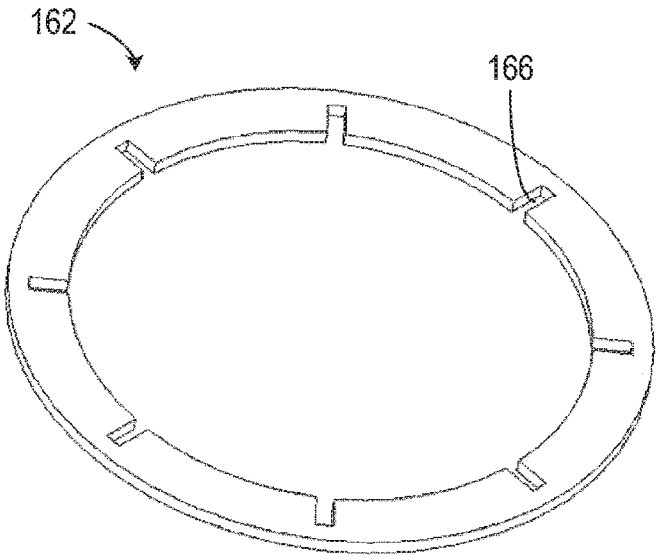
FIG. 5 illustrates another air guiding plate in accordance with one example embodiment.

FIGS. 4 and 5 show the first and second air guiding plates 161 and 162 respectively. In these examples, the first air guiding plate 161 is in the form of a closed ring to be circumferentially fixed to the exterior barrier 130, and the second air guiding plate 162 is in the form of a closed ring to which the interior barrier 140 is circumferentially fixed. There are some protrusions 165 on the outer circumference of the first air guiding plate 161 for engaging with the connecting members 143. There are some notches 166 on the inner circumference of the second air guiding plate 162 for engaging with the ridges 142 on the interior barrier 140. The third and fourth air guiding plates 163, 164 can be arranged in similar ways.

From simulation results, by arranging a meander route with five first air guiding plates and five second air guiding plates for a stack of wire disks having a height of 123 cm and having air gaps of 2.2 cm, the temperature at the coil can be significantly reduced. Compared with a model without any air guiding plate, for the model having five first air guiding plates and five second air guiding plates, the average temperature at the coil can be lowered by about 30 degrees Celsius from 80° C., and the highest temperature during the simulation period at the coil can be lowered by about 20 degrees Celsius from about 100° C.

While operations are depicted in a particular order in the above descriptions, it should not be understood as requiring that such operations be performed in the particular order shown or in sequential order, or that all illustrated operations be performed, to achieve desirable results. In certain circumstances, multitasking and parallel processing may be advantageous. Likewise, while several details are contained in the above discussions, these should not be construed as limitations on the scope of the subject matter described herein, but rather as descriptions of features that may be specific to particular embodiments. Certain features that are described in the context of separate embodiments may also be implemented in combination in a single embodiment. On the other hand, various features that are described in the context of a single embodiment may also be implemented in multiple embodiments separately or in any suitable subcombination.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A transformer, comprising:

a first coil including a first stack of wire disks stacked in a first direction;

an exterior barrier arranged to form a first air gap between outer sides of the wire disks of the first stack of wire disks and the exterior barrier;

an interior barrier arranged to form a second air gap between inner sides of the wire disks of the first stack of wire disks and the interior barrier;

a wind generator arranged to generate an air flow in the first direction;

a core in the form of a cylinder that is surrounded by the first coil; and a plurality of air guiding plates to guide the air flow in a second direction along first stack gaps between the wire disks of the first stack of wire disks, the plurality of air guiding plates comprising (a) a first air guiding plate fixed to the exterior barrier and including a plurality of protrusions coupled to the interior barrier, and (b) a second air guiding plate fixed to the interior barrier.

2. The transformer according to claim 1, wherein the interior barrier comprises a plurality of ridges extending in the first direction, and wherein the second air guiding plate includes a plurality of notches that engage the plurality of ridges to couple the second air guiding plate to the interior barrier.

3. The transformer according to claim 1, wherein the first direction is a vertical direction, and the first air guiding plate and the second air guiding plate are at different altitudes.

4. The transformer according to claim 3, wherein the core is arranged to be coaxial with the first coil, the exterior barrier and the interior barrier.

5. The transformer according to claim 4, wherein the first air guiding plate is in the form of a closed ring to be circumferentially fixed to the exterior barrier, and the second air guiding plate is in the form of a closed ring to which the interior barrier is circumferentially fixed.

6. The transformer according to claim 1, wherein at least one air guiding plate plurality of air guiding plates protrudes into at least one of the first stack gaps.

7. The transformer according to claim 1, wherein the first direction is angled with respect to the second direction by an angle between 80 to 100 degrees.

8. The transformer according to claim 1, wherein the wind generator is arranged to generate the air flow upwardly.

9. The transformer according to claim 1, further comprising:

a second coil including a second stack of wire disks stacked in the first direction, wherein the second coil is arranged between the core and the interior barrier, wherein a third air gap is formed between the interior barrier and outer sides of the wire disks of the second stack of wire disks, wherein a fourth air gap is formed between the core and inner sides of the wire disks of the second stack of wire disks, and wherein the wire disks of the second stack of wire disks are arranged to be in parallel with the wire disks of the first stack of wire disks.

10. The transformer according to claim 9, further comprising:

a third air guiding plate fixed to the interior barrier; and a fourth air guiding plate fixed to the core, wherein both of the third air guiding plate and the fourth air guiding plate protrude into at least one of second stack gaps between the wire disks of the second stack of wire disks, to guide the air flow in the second direction along the second stack gaps.

11. The transformer according to claim 10, wherein the second coil surrounds the core and is arranged to be coaxial with the core and the interior barrier.

12. The transformer according to claim 11, wherein the third air guiding plate is in the form of a closed ring to be circumferentially fixed to the interior barrier, and the fourth air guiding plate is in the form of a closed ring to which the barrier of the core is circumferentially fixed.

13. The transformer according to claim 1, further comprising a second coil including a second stack of wire disks stacked in the first direction;

a third air guiding plate fixed to the interior barrier; and a fourth air guiding plate fixed to the core, wherein the air guiding plate includes a first air guiding plate fixed to the exterior barrier and a second air guiding plate fixed to the interior barrier, wherein the first direction is a vertical direction, and the first air guiding plate and the second air guiding plate are at different altitudes, wherein the first air guiding plate is in the form of a closed ring to be circumferentially fixed to the exterior barrier, and the second air guiding plate is in the form of a closed ring to which the interior barrier is circumferentially fixed, wherein the air guiding plate protrudes into at least one of the first stack gaps, wherein the first direction is angled with respect to the second direction by an angle between 85 to 95 degrees, wherein the wind generator is arranged to generate the air flow upwardly, wherein the second coil is arranged between the core and the interior barrier, wherein a third air gap is formed between the interior barrier and outer sides of the wire disks of the second stack of wire disks, wherein a fourth air gap is formed between the core and inner sides of the wire disks of the second stack of wire disks, wherein the wire disks of the second stack of wire disks are arranged to be in parallel with the wire disks of the first stack of wire disks, wherein both of the third air guiding plate and the fourth air guiding plate protrude into at least one of second stack gaps between the wire disks of the second stack of wire disks, to guide the air flow in the second direction along the second stack gaps, wherein the core and is arranged to be coaxial with the first coil, the second coil, the exterior barrier and the interior barrier, wherein the third air guiding plate is in the form of a closed ring to be circumferentially fixed to the interior barrier, and the fourth air guiding plate is in the form of a closed ring to which the barrier of the core is circumferentially fixed, and wherein the third air guiding plate and the fourth air guiding plate protrude into at least one of the second stack gaps.

14. The transformer according to claim 4, wherein the first direction is angled with respect to the second direction by an angle between 80 to 100 degrees.

15. The transformer according to claim 5, further comprising:

a second coil including a second stack of wire disks stacked in the first direction, wherein the second coil is arranged between the core and the interior barrier, wherein a third air gap is formed between the interior barrier and outer sides of the wire disks of the second stack of wire disks, wherein a fourth air gap is formed between the core and inner sides of the wire disks of the second stack of wire disks, and wherein the first direction is angled with respect to the second direction by an angle between 80 to 100 degrees.

16. The transformer according to claim 4, wherein the air guiding plate protrudes into at least one of the first stack gaps, wherein the first direction is angled with respect to the second direction by an angle between 80 to 100 degrees.

17. The transformer according to claim 2, wherein the plurality of protrusions of the first air guiding plate are coupled to the ridges of the interior barrier.

18. The transformer according to claim 3, further comprising a plurality of connecting members that couple the protrusions of the first air guiding plate to the ridges of the interior barrier.

* * * * *